United States Patent [19]

Jecmen, deceased et al.

[11] 4,224,767

[45] Sep. 30, 1980

[54] FIRE STOP SAFETY ASTRAGAL

[75] Inventors: James M. Jecmen, deceased, late of Indianhead Park, Ill., by Elinore M. Jecmen, executrix nominee; John J. Jecmen, Oak Brook, Ill.

[73] Assignee: Harris Preble Company, Chicago, Ill.

[21] Appl. No.: 15,759

[22] Filed: Feb. 27, 1979

[51] Int. Cl.[2] ..... E06B 7/16

[52] U.S. Cl. ..... 49/488; 49/498; 49/499; 49/370

[58] Field of Search ..... 49/366, 370, 488, 494, 49/490, 493, 498, 499, 368

[56] References Cited

U.S. PATENT DOCUMENTS

| | | | |
|---|---|---|---|
| 1,948,942 | 2/1934 | Ross | 49/488 X |
| 2,663,057 | 12/1953 | Uphoff | 49/488 |
| 2,891,289 | 6/1959 | Guilbert, Jr. | 49/488 |
| 3,943,663 | 3/1976 | Jecmen et al. | 49/488 X |

*Primary Examiner*—Kenneth Downey

*Attorney, Agent, or Firm*—Cook, Wetzel & Egan, Ltd.

[57] ABSTRACT

An astragal is formed by securing lengthwise flexible fire-resistant material to a mounting channel adapted to be mounted on an elevator fire door. The flexible fire-resistant material of the astragal is secured to the upwardly extending flanges of the mounting channel to form an elongated boot of uniform cross-section, wherein the astragal nose is substantially parallel to the mounting channel thereby insuring an effective fire seal.

14 Claims, 4 Drawing Figures

FIRE STOP SAFETY ASTRAGAL

BACKGROUND OF THE INVENTION

A. Field of the Invention

The present invention relates to safety astragals for elevator fire doors and more particularly to safety astragals designed for use on horizontally divided, vertically moving freight elevator fire doors and fire doors for vertical conveyors.

Freight elevator fire doors are typically comprised of two separate vertically moving sections, which are positioned between vertically disposed guide rail members which are attached on walls forming the elevator shaft. The door sections are guided in their vertical opening and closing movements by guide means attached to the vertical edges of the door sections which cooperate with and engage an inwardly extending flange member of the guide rail assembly. In opening and closing movements, the door sections move in a vertical plane in opposed relation to each other, which movement is controlled by flexible connecting members secured to each side of each door section with the flexible connecting members running over respective sheaves members secured to the guide rail assemblies.

Elevator fire doors of the counterbalanced type are conventionally used at elevator landing openings to prevent the spreading of fire between floors of a building by communication through the elevator shaft. In order to provide a fire-tight seal between the two door sections when closed, it was at one time common practice to provide a structural steel angle section on the upper door which overlapped the lower door, when the doors were in the closed position. The angle section prevented fire from passing through any space which might have existed between the doors and also prevented the introduction of objects between the doors for deposit or discharge into the shaftways. The fire seal angles, however, while they were suitable for providing a fire-tight seal, introduced a hazard upon closing the doors, since the angle also functioned as a guillotine which would tend to shear off anything left in between the doors. The steel angle sections were particularly dangerous to fingers, hands, wrists, or feet of persons who did not take sufficient care to avoid injury. The overlapping angle astragal also projected into the doorway 2 or 3 inches. Thus, if an elevator required an unobstructed vertical opening of 7 feet, a framed masonary opening of 7feet 2 inches or 7 feet 3 inches would have to be provided. Many architects and end users were not cognizant of this downward projection thus ending up with an unobstructed opening insufficient to permit the passage of loads having certain popular heights.

B. Description of the Prior Art

A variety of astragals fabricated from various fireproof materials have been proposed. Earlier safety astragals consisted of a cylinder fabricated from wire-reinforced, neoprene-coated asbestos and are described in U.S. Pat. No. 2,923,984, Canadian Pat. No. 524,866 (issued May 8, 1956) and elsewhere. Such cylindrical astragals employed spring-like reinforcing members within the astragal as functional elements employed to mount the astragal on the elevator door. In order to obtain Underwriter's approval of elevator doors, the doors with the astragals mounted thereon must be subjected to rigorous tests both as to their fire-resisting qualities and also their resistance to disintegration by the hose stream test which is applied immediately after the fire test. Since the forces employed in closing freight elevator doors are of 35 to 50 pounds, in order to produce a neoprene-asbestos fabric cylinder which will withstand repeated stresses and compression to seal, it is necessary to build a thick and strong cylinder. It has been found that when cylindrical astragals are fabricated to specifications which produce adequate fire protection and resistance to physical stresses, they are not easily compressed. These conditions are due to aging of a comparatively rigid hose-like structure. It has also been found that many injuries can occur when a finger or hand or other limb is caught between the lower sill and the astragal. Even in those cases where there is no metal-to-metal contact, serious injury can take place.

U.S. Pat. No. 3,943,663 describes an astragal fabricated by sewing together two layers of flexible fireproof material with heavy cotton thread which was then formed into an envelope around a contiguous solid mounting bar. Envelope astragals fabricated from two layers of fire-resistant material, while reducing the possibility of injury, are difficult to manufacture in an absolutely uniform cross-section. Because of the difficulty in fastening the envelope material on the mounting bar in a uniform manner, the height of the astragal is not always uniform on the envelope astragals. As a result the envelope astragals, such as disclosed in U.S. Pat. No. 3,943,663, show a tendency to be somewhat uneven and buckle slightly, which in turn causes difficulty maintaining sufficient force on the envelope to produce an effective fire seal between the astragal and trucking sill or the lower panel. Increasing the latching force does not necessarily overcome deficiencies in the sealing properties resulting from buckling or rippling of the sealing edge of the envelope astragal. Envelope astragals also suffer from the fact that they are expensive to manufacture. These higher expenses in manufacturing are attributed to material costs and the difficulties inherent in fabricating an envelope astragal. It is particularly difficult to fabricate an envelope astragal to be of uniform character to reduce the tendency of the astragal nose to buckle.

SUMMARY OF THE INVENTION

The astragal of the present invention is formed by securing flexible, fire-resistant material to both flanges of a mounting channel to form a boot astragal, which is affixed to an elevator door. The fire-resistant material is joined to the mounting channel, with securing means such as stitching or stapling, along lines spaced substantially equidistant from the nose of the astragal boot. The astragal of the present invention has a uniform cross-section, free from buckling, with the lowermost portion of the astragal, i.e., the nose, being substantially parallel to the mounting channel, which provides a superior fire seal. Another advantage of the present invention is the low manufacturing costs which result from the ease in fabricating the astragal and reduced material costs.

The preferred embodiment of the astragal of the present invention is further provided with a channel cap which covers the mounting channel flanges and ends of the astragal boot, securing the astragal boot to the mounting channel.

The present invention provides an astragal which is sufficiently flexible to avoid injury induced by crushing and effective in producing a fire seal. The safety astragal of the present invention is of simple construction and is readily fabricated so as to provide a substantially horizontal equidistant continuum between the astragal nose and the mounting channel, thereby providing a uniform cross-section and an effective fire seal when the elevator doors are closed and the astragal nose is flattened against the trucking sill of the lower door.

The present invention further provides an astragal which forms an effective fire seal when minimal compression or latching forces are applied between the elevator doors which flattens the astragal nose against the trucking sill.

The present invention also provides a readily fabricated astragal requiring a lesser amount of overall material and is more economical to manufacture than prior art astragals and is readily adapted to new or existing elevator doors.

Other advantages of the present invention will be readily appreciated by those skilled in the art by reference to the following description, when considered in connection with the accompanying drawing in which:

DETAILED DESCRIPTION OF THE PREFERRED EMBODIMENT

Figure 1:
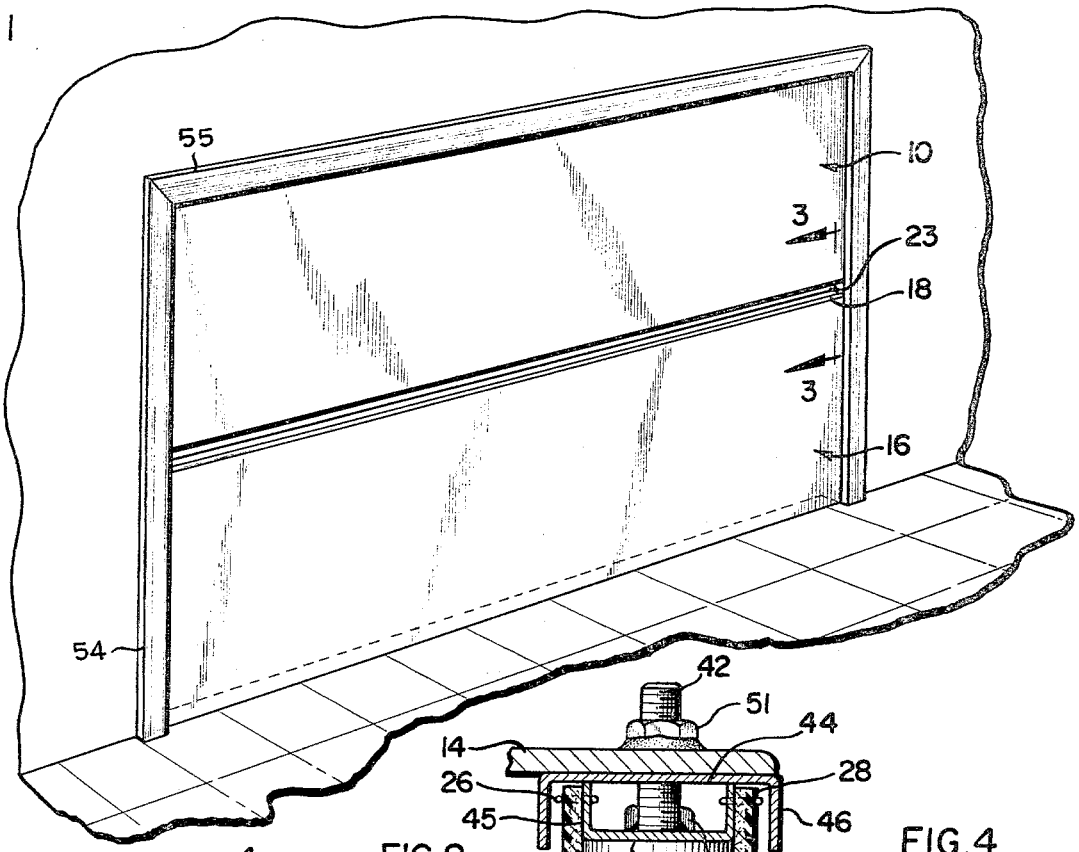
FIG. 1 is a perspective view, as seen from outside of the elevator shaft, of a pair of elevator doors, with the astragal of the present invention affixed to the lower surface of the upper door.
Figure 3:
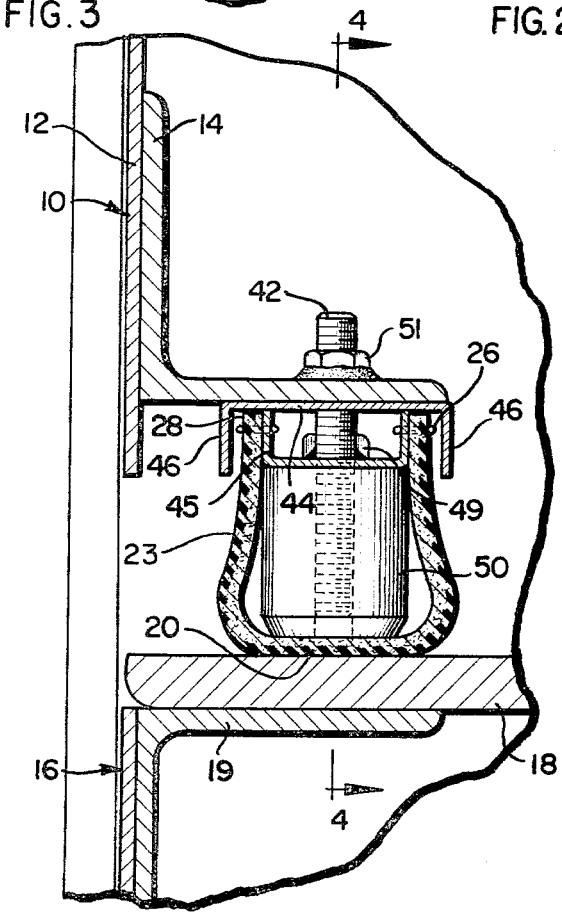
FIG. 3 is a transverse vertical end view, taken in section along line 3—3 of FIG. 1, of the astragal of the present invention compressed by the latching force, and illustrates the preferred embodiment.
Figure 4:
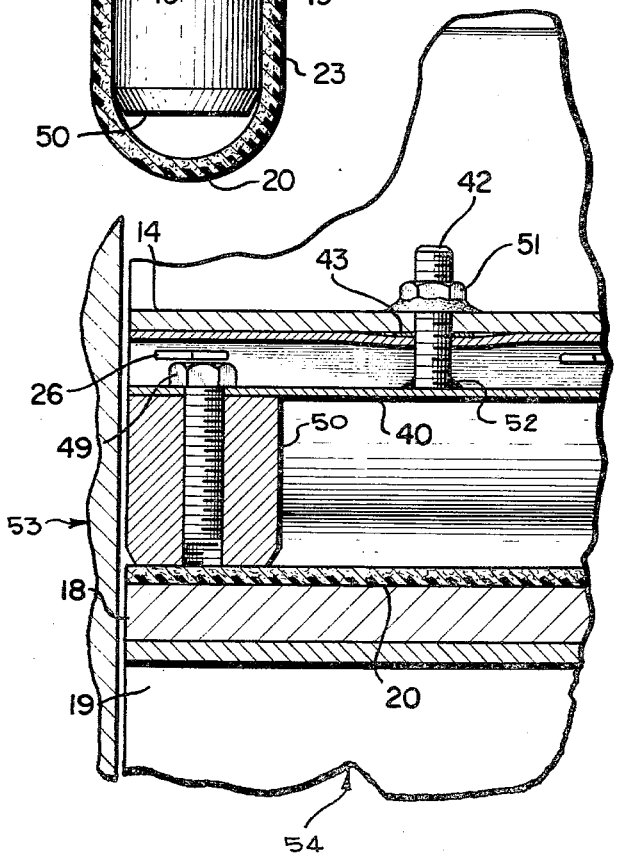
FIG. 4 is a fragmentary longitudinal view of the astragal of the present invention taken in section at approximately line 4—4 of FIG. 3.

Referring more particularly to the drawing, FIG. 1 shows a pair of horizontally divided, vertically operating freight elevator doors 10 and 16, in which upper door 10 has a boot astragal 23 affixed to its lower frame angle and further illustrates door jams 54 and lintel 55. As is shown in FIGS. 1, 3, and 4, the doors are in the closed position, whereby the astragal nose 20 is in contact with the trucking sill 18 of lower door 16 in a flattened contact configuration. Those skilled in the art will be aware that the astragal of the present invention may be used in connection with a single, or multiple section, vertically moving door, in which case a stationary trucking sill would function in the same manner as the trucking sill 18 of the lower door 16.

Figure 2:
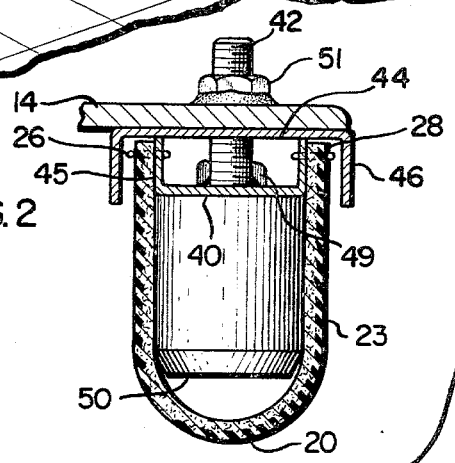
FIG. 2 is a transverse vertical view, taken in section along line 3—3 of FIG. 1, of the astragal of the present invention mounted on a door in a relaxed condition and illustrates the preferred embodiment.

FIG. 2 shows a boot astragal 23 in a relaxed condition as it would substantially appear on an open elevator door. Astragal nose 20 is depicted as it would appear in the absence of a latching force. The edges 28 of the flexible fire-resistant material are attached by securing means 26 to upwardly extending vertical flanges 45 of mounting channel 40. The edges 28 of boot astragal 23 extend upwardly and are in substantially continuous contact with flanges 45 of mounting channel 40.

As is shown in FIGS. 1 and 3, the upper door 10 comprises a face plate 12 which is affixed to a door frame angle 14, which provides a horizontal surface to which the boot astragal 23 is mounted. FIGS. 1 and 3 show a lower door 16 which is usually similarly constructed, except that a heavy trucking sill 18 is typically affixed to the lower door frame angle 19 whereby the trucking sill 18 serves as the horizontal contact surface for the astragal nose 20.

The astragal of the present invention is shown in transverse cross-section in FIG. 2. In FIGS. 2 and 3, the boot astragal 23 is in place, and attached to the door. As is shown, the astragal is formed from an elongated, flexible piece of fabric of flexible fireproof material, which preferably is a neoprene-coated, brass wire-reinforced asbestos cloth. Preferably the fabric is precut to width and has substantially parallel edges.

The flexible fireproof material is secured by suitable securing means 26, preferably by stitching or stapling, to the mounting channel 40 to form the boot astragal 23. As is shown by FIGS. 2 and 3, securing means 26 are located near both edges 28 of boot astragal 23 in such a manner that securing means 26 on both flanges 45 of mounting channel 40 form a substantially horizontal plane relative to the trucking sill 18 of lower door 16. As is shown by FIG. 4, securing means 26 are preferably substantially equidistant from the astragal nose 20 thereby forming a substantially horizontal plane relative to trucking sill 18.

However, it would be apparent to one of ordinary skill in the art that provided the edges 28 of the boot are flush with the upper edges of flanges 45 of mounting channel 40, the vertical distance between securing means 26 and astragal nose 20 may fluctuate, e.g., plus or minus one thirty-second of an inch from staple to staple, without adversely affecting the efficiency of the present invention.

The securing means 26 preferably consist of stapling or stitching and are readily installed by appropriate machinery as a consequence of the configuration of the mounting channel 40 as shown in FIGS. 2 and 3. It has been found, for example, that wire stitching or stapling consisting of 0.047 inch (1.193 mm) diameter wire and having a 0.5 inch (12 mm) crown is suitable for securing means 26. It has been found that a spacing distance of up to 10 inches between staples 26 is sufficient to maintain the integrity of the fire sealing properties of the present invention. However, the present invention is not limited to the use of any particular spacing as will be apparent to those skilled in the art.

Preferably, threaded studs 42 are affixed to the upper surface of mounting channel 40. The studs 42 serve to affix the astragal to the upper door frame angle 14. Preferably the studs 42 are welded to mounting channel 40, but the studs may be attached to the mounting channel 40 by any convenient means.

FIGS. 2 and 3 also show the preferred embodiment wherein a channel cap 44 is adapted to fit over mounting channel 40. Aperatures in channel cap 44, which may be drilled or punched, are provided at suitable intervals to register with studs 42. Channel cap 44 is preferably fitted over studs 42, whereby the flanges 46 of channel cap 44 overlap the flanges 45 of mounting channel 40. Preferably, the flanges 46 of channel cap 44 overlap and engage the securing means 26 and the edges 28 of the boot astragal 23. Preferably the size of channel cap 44 is adequate to surround the securing means 26. The channel cap serves to protect securing means 26, thereby insuring the integrity of boot astragal 23. The distance between the outer ends of flanges 46 of channel cap 44 and the astragal nose 20 contacted with the trucking sill 18 is preferably within the range of three-quarters of an inch and two inches.

For ease of installation, if desired, speed nut 43 may be employed to secure the channel cap to the astragal assembly as a unit prior to mounting on door.

Fastening means, illustrated by nuts 51 having conventional skirts as shown, may be employed to mount the astragal assembly to the door in the conventional position as depicted in FIGS. 2, 3, and 4. However, any appropriate affixing means may be employed in lieu of nuts 51 and speed nuts 43 as will be readily apparent to one of ordinary skill in the art.

In a preferred embodiment, a bumper 50 is mounted within the boot astragal 23 and is affixed to mounting channel 40. As is shown in FIG. 4, the bumper 50 is secured to mounting channel 40 by bolt 49, but it may be affixed by other means which will be known to those skilled in the art. The primary function of bumper 50 is to prevent metal-to-metal contact when the doors are in the closed position. Although the bumper 50 may help to hold boot astragal 23 in a desired shape or configuration, the bumper is not required. FIGS. 2, 3, and 4, show a preferable embodiment wherein bumper 50 is positioned at both ends of the mounting channel 40. FIGS. 2 and 3 show the side view along line 3—3 of FIG. 1 illustrating bumper 50 positioned within the astragal to prevent the possibility of injury. Stud 42 and its welding fillets 52 are shown in front of bolt 49 securing bumper 50 to mounting channel 40. FIG. 4 illustrates bumper 50 located within the astragal in a position next to the building wall 53 and adjacent to the vertical door jam 54. The bumper 50 may be fabricated from steel or a suitable resilient material as is known to persons skilled in the art. However, it should be understood that the present invention is not limited to the use of any given number or style of bumpers, nor is it limited to the use of bumpers as a portion of the astragal.

A significant advantage of the present invention is the ease of fabricating the astragal wherein the boot astragal 23 is affixed by securing means 26 to a mounting channel 40 having upwardly extending flanges 45. Said securing means such as staples are economically fabricated in such a manner that a substantially parallel or equidistant horizontal plane is formed between the continuum of staples 26 on either flange 45 of mounting channel 40 and the astragal nose 20 of boot astragal 23. The astragal of the present invention provides a more uniform and effective fire seal because a minimal latching force between the upper door 10 and lower door 16 will cause the astragal nose 20 to assume a flattened configuration with no buckling.

Mounting channel 40 may be provided with a plurality of studs 42 along the length. However, the invention is not limited to any particular quantity or spacing of studs 42. It has been found, for example, that two studs located two inches respectively from either end of mounting channel 40 with intermediate studs approximately 12 inches on center is sufficient to affix the astragal to the door frame angle 14.

The present invention is not limited to any particular type of flexible fireproof fabric to make up the boot astragal 23. Various commercially available ferrous or non-ferrous wire reinforced asbestos fabrics which are coated with neoprene, fluoro elastomers and other materials are satisfactory. Such materials are available precut with parallel sides to a variety of widths and lengths. While the ferrous or non-ferrous metallic reinforced asbestos fabric is preferred, with brass being the most preferred, neoprene-coated asbestos fabrics which are not reinforced with metal are also contemplated. It has been found that asbestos cloths of one-eighth inch thickness can be fabricated into astragals which have passed the Underwriters tests when used in connection with the present invention.

The forms of invention herein shown and described are to be considered only illustrative. It will be apparent to those skilled in the art that numerous modifications may be made therein without departure from the spirit of the invention or the scope of the appended claims.

What is claimed as new and desired to be secured by Letters Patent in the United States is:

1. An astragal for an elevator door, said astragal comprising an elongated boot of flexible fire-resistant material, a mounting channel having upwardly extending vertical flanges, securing means, and door engaging means, said astragal being formed by bending said fire-resistant material lengthwise to form a boot which contacts said vertical flanges of said mounting channel, whereby the edges of said boot extend upwardly and are in substantially continuous contact with the vertical flanges of said mounting channel and secured thereto by said securing means, said door engaging means affixed to said mounting channel and adapted to attach said astragal to said elevator door.

2. An astragal as described in claim 1, wherein said upwardly extending edges of said boot are substantially equidistant from the nose or lowermost surface of said astragal to provide a substantially uniform cross-section for said astragal.

3. An astragal as described in claim 1, wherein said securing means comprise wire stitching.

4. An astragal as described in claim 1, wherein said securing means comprise stapling.

5. An astragal as described in claim 1, which includes a bumper dimensioned and positioned on said mounting channel within said astragal whereby said bumper prevents rigid members of meeting panels from contacting one another.

6. An astragal as described in claim 1, wherein said door engaging means comprises at least two threaded studs affixed to said mounting channel wherein fastening means are applied to said studs to affix said astragal to said door engaging means.

7. An astragal as described in claim 1, wherein said flexible fire-resistant material is brass wire reinforced neoprene-coated asbestos cloth.

8. An astragal as described in claim 1, which includes a channel cap invertedly affixed to said mounting channel, said channel cap having flange members which overlap said securing means.

9. An astragal as described in claim 8, wherein said upwardly extending edges of said boot are substantially equidistant from the nose of said astragal to provide a substantially uniform cross-section for said astragal.

10. An astragal as described in claim 8, wherein said securing means comprise wire stitching.

11. An astragal as described in claim 8, wherein said securing means comprise stapling.

12. An astragal as described in claim 8, dimensioned and positioned on said mounting channel whereby said bumper prevents rigid members of meeting panels from contacting one another.

13. An astragal as described in claim 8, wherein said door engaging means comprises at least two threaded studs affixed to said mounting channel wherein fastening means are applied to said studs to affix said astragal to said door engaging means.

14. An astragal as described in claim 8, wherein said flexible fire-resistant material is brass-wire reinforced neoprene-coated asbestos cloth.

* * * * *